US005740859A

United States Patent [19]

Finch

[11] Patent Number: 5,740,859

[45] Date of Patent: Apr. 21, 1998

[54] PLATE HEAT EXCHANGER

[75] Inventor: Derek Ian Finch, Goldsboro, N.C.

[73] Assignee: APV Corporation Limited, England

[21] Appl. No.: 491,924

[22] PCT Filed: Jan. 18, 1994

[86] PCT No.: PCT/GB94/00095

§ 371 Date: Jul. 18, 1995

§ 102(e) Date: Jul. 18, 1995

[87] PCT Pub. No.: WO94/17354

PCT Pub. Date: Aug. 4, 1994

[30] Foreign Application Priority Data

Jan. 20, 1993 [GB] United Kingdom ..... 9301021

[51] Int. Cl.[6] ..... F28F 9/007

[52] U.S. Cl. ..... 165/67; 165/78

[58] Field of Search ..... 165/67, 78, 167

[56] References Cited

U.S. PATENT DOCUMENTS

| | | | |
|---|---|---|---|
| 1,727,124 | 9/1929 | Lonsdale . | |
| 2,601,974 | 7/1952 | Hytte | 165/78 |
| 2,621,028 | 12/1952 | Newhall | 165/78 |
| 2,639,126 | 5/1953 | Newhall | 165/78 |
| 2,754,093 | 7/1956 | Wennerberg | 165/78 X |

FOREIGN PATENT DOCUMENTS

| | | | |
|---|---|---|---|
| 622045 | 6/1961 | Canada | 165/67 |
| 443299 | 8/1991 | European Pat. Off. . | |
| 162507 | 3/1958 | Sweden | 165/67 |
| 2052038 | 1/1981 | United Kingdom . | |
| 2065289 | 6/1981 | United Kingdom . | |

*Primary Examiner*—Leonard R. Leo
*Attorney, Agent, or Firm*—Quarles & Brady

[57] ABSTRACT

A plate heat exchanger comprising a stack of plates defining flow spaces between pairs of adjacent plates, the stack being compressed together between a head and a follower by load bearing rails, the head and the follower are urged together by tie bars. To obtain even compression of the plates the tie bars are as close as possible to the flow spaces. At least one tie bar extends through a cut-out formed within a plate area, the cut-out being bounded at the outer periphery of one of the plates.

12 Claims, 2 Drawing Sheets

PLATE HEAT EXCHANGER

The present invention relates to a plate heat exchanger.

Plate heat exchangers comprise a stack of plates which are pressed together to define flow spaces between pairs of adjacent plates. Heat exchange media flow through alternate spaces and are in heat exchange via the intervening plate. Typically, adjacent plates are sealed together by an elastomeric gasket which sits in a channel in one or both of the plates. Some or all of the plates may be welded of brazed together, and a metal gasket may be used. The heat exchange media are often fed through the heat exchanger under pressure. Consequently, there is a need to compress the plates together and retain this compression under pressure. This is achieved by clamping the stack of plates in a frame between a head and a follower which are urged together by tie bars.

In some known designs the tie bars are located adjacent and to each side of cut-outs in the upper and lower edges of the plates, the cut-outs being used to locate the plates on upper and lower rails.

U.S. Pat. No. 4 813 478 shows a system in which a tie bar is placed at each of the top and bottom edges of the frame, off-set to opposite sides of a vertical centre-line. Tie bars are also provided on each side, off-set vertically relative to one another.

GB-A-2 052 038 discloses a plate heat exchanger in which the tie bars are positioned at intervals along the vertical side edges of the heat exchanger, located in a head and a follower which compress the plates between them.

However, even compression of the stack of plates is best achieved when the tie bars are as close as possible to the flow spaces between the plates.

According to a first aspect of the present invention a plate heat exchanger is provided comprising a stack of plates which are compressed together between a head and a follower by means of tie bars, at least one plate having a cut-out formed within the plate area and bounded by the outer periphery of the plate and at least one tie bar extending through the cut-out of the plate.

According to a second aspect of the invention a plate heat exchanger is provided comprising a stack of plates which are compressed together between a head and a follower by means of tie bars, at least one tie bar extending through an aperture formed within a plate area, wherein the tie bar extends through an aperture in the body of the plate so as to penetrate the plates in a region surrounded by the flow spaces between the plates, the aperture being sealed from the flow spaces by a seal.

The plates may have upper and lower cut-outs or apertures which locate the plates between top and bottom rails, and the cut-out or aperture through which the tie bar extends is one of the said upper and lower cut-outs or apertures.

Preferably two tie bars are provided, the tie bars extending respectively through the upper and lower cut-outs or apertures in the plate or plates.

Other tie bars may be provided in other locations if desired.

By positioning a tie bar in a cut-out or aperture, which is usually on the centre-line of the plate, even compression of the stack can be achieved, and only a simple modification to the design of the cut-out is required, if at all.

In a preferred embodiment, a rail is tubular and a tie bar extends through the rail.

Other preferred features and advantages of the invention will be apparent from the following description and the accompanying claims.

The invention will be further described by way of example with reference to the accompanying drawings, in which.

Figure 1:
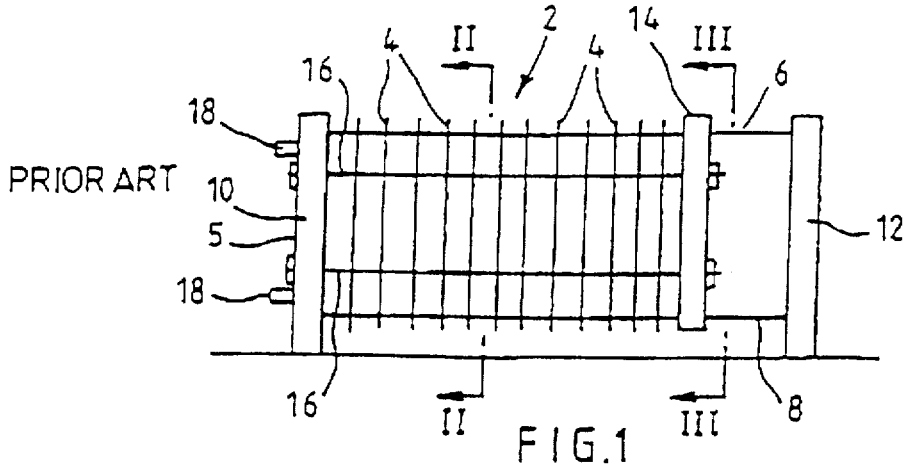
FIG. 1 is a schematic side view of a plate heat exchanger.
Figure 3:
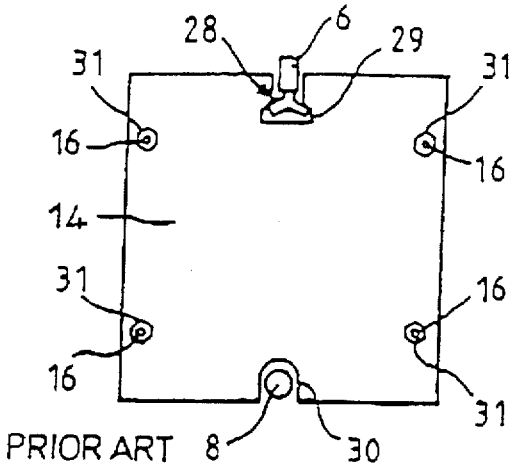
FIG. 3 is a plan view of a follower of the heat exchanger of FIG. 1, along the line III—III.

Referring to FIG. 1, this shows in side view a schematic illustration of a typical plate heat exchanger 2. The heat exchanger 2 consists of a pack of plates 4 held in a frame 5. The plates 4 are suspended from a top rail 6 and located by a bottom rail 8 extending between a head 10 and an end support 12. The plates 4 are pressed together between the head 10 and a follower 14 which is movable along the top and bottom rails 6, 8. The pack of plates 4 is retained in compressed condition by tie bars 16 which extend between the head 10 and follower 14. Usually, the tie bars 16 are even in number and are located evenly on each side of the stack of plates 4, as seen in FIG. 3.

Adjacent plates 4 are sealed together, usually by gaskets, to define spaces between the plates. The media are in heat exchange flow through alternate spaces and are in heat exchange contact through the intervening plates. Fluid connections 18 (usually four in number) are provided on the head 10 for feeding the media to and from the pack of plates.

Figure 2:
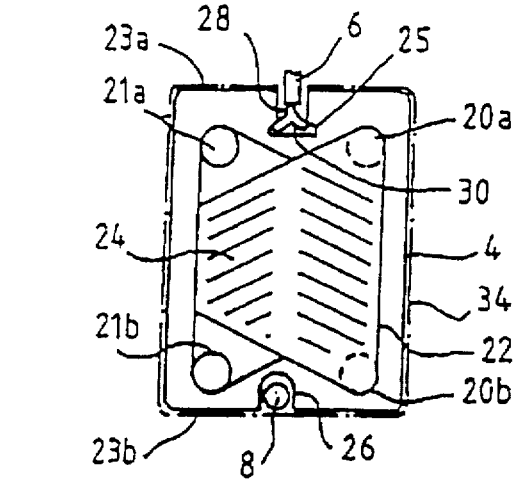
FIG. 2 is a plan view of a plate of the plate heat exchanger of FIG. 1 along the line II—II.

As seen in FIG. 2, which shows a schematic view of a plate 4, the plate 4 has inlet and outlet ports 20*a*, 20*b* which are surrounded by a gasket 22 which defines a flow space 24 in communication with the ports 20*a*, 20*b*. The flow space 24 is defined between the plate 4 shown, the gasket 22 and another complementary plate 4 in front of the plane of the drawing. Ports 21*a*, 21*b* in the plate 4 are isolated from the flow space 24 by the gasket 22, the ports 21*a*, 21*b* and feed a second fluid through to an adjacent flow space defined behind the plate 4.

A out-out in upper edge 23*a* of the plate 4 forms a hanging eye 25 which embraces the top rail 6 and a second cut-out in the lower edge 23*b* of the plate 4 forms a guide eye 26 which sits over the bottom rail 8. The top rail 6 has a bifurcation 28 at its lower edge, the bifurcation extending along the length of the rail 6.

It can be seen that the outer perimeter 34 of the plate 4 defines a plate area bound by the chain-dotted line, the cut-outs 25, 26 extending into the plate area.

As seen in FIG. 3, the follower 14 is similarly provided with a hanging eye 29 and a guide eye 30, and in addition has apertures 31 for receiving the tie bars 16, the tie bars extending alongside the stack of plates 4.

Placing the tie bars to each side of the stack of plates is convenient, but is not always the most efficient solution. It is also known to place the tie bars to one or both sides of the hanging eyes 25, 29 in the head 10 and follower 14, but displaced vertically to be clear of the plates.

Figure 4:
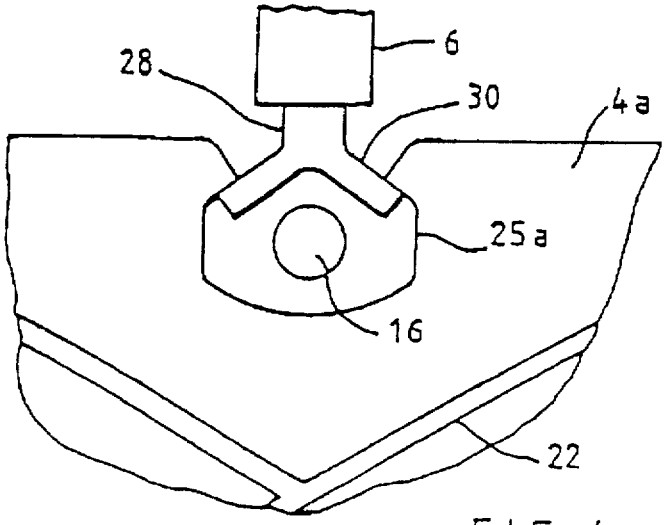
FIG. 4 is a detail from a plate of a heat exchanger of the type seen in FIG. 1, and illustrating a first embodiment of the invention.

FIG. 4 shows a first embodiment of the invention, in which a plate 4*a* is constructed generally as, seen in FIG. 2, a stack of the plates 4*a* being assembled together to form a plate heat exchanger as seen in FIG. 1. In this embodiment, a tie bar 16 extends through the hanging eye 25*a*. Conveniently, the tie bar 16 is positioned near and below the hanging rail bifurcation 28. The hanging eye 25*a* may be enlarged downwardly compared to the FIG. 2 arrangement, to provide room for the tie bar 16. It can be seen from FIG. 2 that the usual plate design provides space for enlargement of the hanging eye in this direction without encroaching on the flow space 24.

The corresponding follower (not shown) may have an eye shaped to receive snugly the tie bar 16, so that a tightening nut can bear on the follower, or a tommy bar, washer plate, or other means may be provided.

Figure 5:
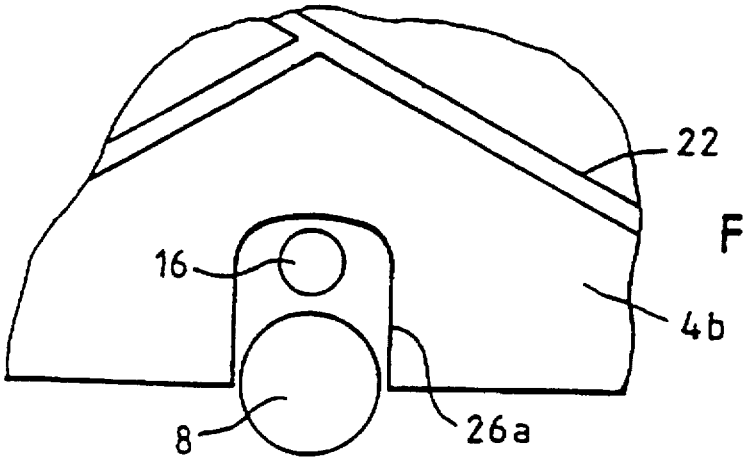
FIG. 5 illustrates a second embodiment of the invention.

FIG. 5 shows a second embodiment of the invention, in which a tie bar 16 is positioned in the lower guide eye 26*a*. The guide eye 26*a* may be extended upwardly if necessary to accommodate the tie bar 16 without encroaching on the flow space. The guide rail 8 may be another cross-sectional shape, such as square, to offer greater space for the tie bar 16.

Figure 6:
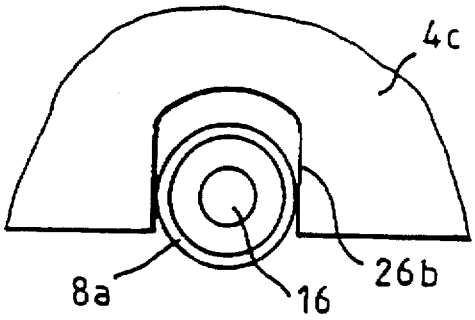
FIG. 6 illustrates a third embodiment of the invention.

FIG. 6 shows a third embodiment of the invention, in which a tie bar 16 passes through the bottom rail 8*a*, the rail 8*a* being hollow, and telescoped or compressible to allow tightening of the tie bar 16 against the follower.

Figure 7:
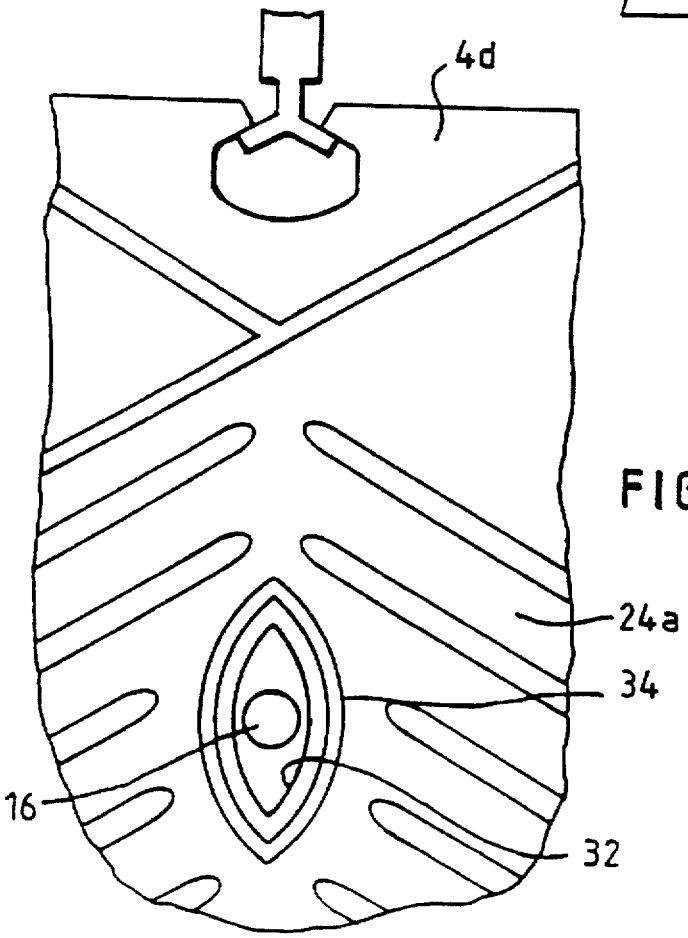
FIG. 7 illustrates a fourth embodiment of the invention.

FIG. 7 shows a fourth embodiment in which at least one tie bar 16 passes through apertures 32 in the plates 4*d*, in a position surrounded by the flow spaces 24*a* and separated thereform by a seal 34, such as for example a metal or an elastomeric gasket, or a welded or brazed seal.

It will be appreciated that a tie bar 16 may be wholly positioned, when viewed in cross-section, within a cut-out, or it may protrude outside of the cut-out and hence outside of the plate area. It is particularly preferred to use, for the tie bars, cut-outs or apertures on the vertical centre line of the plates.

Various modifications may be made to the embodiments of the invention and it is desired to include all such modifications as fall within the scope of the accompanying claims.

I claim:

1. A plate heat exchanger comprising a head, a follower, a stack of plates disposed between said head and said follower, and supported by a rail, tie bars for compressing said plates together between said head and said follower, wherein at least one tie bar extends through a cut-out formed within a plate area, and at least one of said plates has an outer periphery which bounds said cut-out, and wherein said at least one tie bar is located on the vertical center line of the heat exchanger.

2. A plate heat exchanger as claimed in claim 1, wherein one of the rails is tubular and one of the tie bars extends through said one of the rails.

3. A plate for a heat exchanger as defined in claim 1.

4. A plate heat exchanger comprising a head, a follower, a stack of plates disposed between said head and said follower, tie bars for compressing said plates together between said head and said follower, wherein at least one tie bar extends through a cut-out formed within a plate area, and at least one of said plates has an outer periphery which bounds said cut-out, and wherein said plates have an upper cut-out and a lower cut-out which locate said plates between top and bottom rails, and the cut-out through which the tie bar extends is one of said upper and lower cut-outs.

5. A plate heat exchanger as claimed in claim 4, wherein a first tie bar extends through the upper cut-out of the plates and a second bar extends through the lower cut-out of plates.

6. A plate heat exchanger as claimed in claim 5, wherein the first tie bar is positioned in the upper cut-out, below the top rail.

7. A plate heat exchanger as claimed in claim 5, wherein the second tie bar extends through the lower cut-out and is positioned above the bottom rail.

8. A plate heat exchanger as claimed in claim 4, wherein the tie bar is positioned in the upper cut-out, below the top rail.

9. A plate heat exchanger as claimed in claim 8, wherein the top rail is bifurcated at its lower edge and has a crotch, and the tie bar is positioned in the crotch of the bifurcation.

10. A plate heat exchanger as claimed in claim 9, wherein a second tie bar extends through the lower cut-out and is positioned above the bottom rail.

11. A plate heat exchanger as claimed in claim 8, wherein a second tie bar extends through the lower cut-out and is positioned above the bottom rail.

12. A plate heat exchanger as claimed in claim 4, wherein the tie bar extends through the lower cut-out and is positioned above the bottom rail.

* * * * *